United States Patent [19]

Leo et al.

[11] Patent Number: 4,771,310

[45] Date of Patent: Sep. 13, 1988

[54] STRIPPER FINGER MECHANISM FOR EFFECTING REMOVAL OF A RECORD MEDIUM FROM A ROLL MEMBER

[75] Inventors: Timothy J. Leo; Joseph A. Yarbrough, both of Rochester; Robert G. Pirwitz, Fairport, all of N.Y.

[73] Assignee: Xerox Corporation, Stamford, Conn.

[21] Appl. No.: 50,588

[22] Filed: May 15, 1987

[51] Int. Cl.[4] ..... G03G 15/00

[52] U.S. Cl. ..... 355/3 SH; 271/311

[58] Field of Search ..... 355/3 FU, 3 SH; 271/308, 311–313, 900

[56] References Cited

U.S. PATENT DOCUMENTS

| | | | |
|---|---|---|---|
| 970,441 | 9/1910 | Gammeter . | |
| 1,884,397 | 10/1932 | Upham | 271/308 |
| 2,211,766 | 8/1940 | Brown, Jr. | 271/63 |
| 3,936,045 | 2/1976 | Ariyama | 271/174 |
| 3,938,950 | 2/1976 | Weiler et al. | 271/900 |
| 4,060,320 | 11/1977 | Doi et al. | 271/900 |
| 4,156,524 | 5/1979 | Bar-on et al. | 271/174 |
| 4,264,181 | 4/1981 | Lentz et al. | 355/3 FU |
| 4,336,992 | 6/1982 | Szlucha et al. | 355/3 FU |
| 4,447,054 | 5/1984 | Sone | 271/900 |

FOREIGN PATENT DOCUMENTS

| | | | |
|---|---|---|---|
| 60-51868 | 3/1985 | Japan | 355/3 FU |
| 60-130779 | 7/1985 | Japan | 355/3 SH |

*Primary Examiner*—Arthur T. Grimley
*Assistant Examiner*—J. Pendegrass

[57] ABSTRACT

A stripper finger mechanism is provided for separating record sheets from the surface of a roll member. In a preferred embodiment, a plurality of flexible stripper fingers are arranged so that the finger ends are angled against a fuser roller surface to effect initial separation of a fused copy sheet. The fingers have generally centrally located raised edges to provide a gradually sloping rigid support which lifts the fused copy sheet following initial separation.

4 Claims, 4 Drawing Sheets

STRIPPER FINGER MECHANISM FOR EFFECTING REMOVAL OF A RECORD MEDIUM FROM A ROLL MEMBER

BACKGROUND AND PRIOR ART

This invention relates generally to apparatus for removing copy medium from a roll member, and, more particularly, to means for facilitating the removal of a copy sheet from a fuser roll apparatus.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by the use of heat and pressure.

It is known to use various combinations of heated rollers and pressure roller and combinations thereof as the fusing mechanism. With these roller configurations, the toner image sometimes forms a strong bond between the fuser roll surface and the copy sheet. It may therefore, at some point be necessary to separate the fused copy sheet from the fuser roller. Various mechanical stripping devices are known from the prior art. In U.S. Pat. No. 4,336,992, assigned to Xerox Corporation, a rotatable flexible stripper finger structure is used to strip copy sheets from a heated pressure roller assembly. U.S. Pat. No. 4,264,181 discloses a heated roll/backup roll fuser arrangement with a plurality of chisel fingers 30 separating copy sheets from the heated roller. U.S. Pat. No. 4,156,524, also assigned to Xerox Corporation, discloses an elongated stripping blade member which is used to strip the copy sheet from the heated fuser roll surface.

U.S. Pat. No. 970,441 to Gammeter describes a paper stripping device for stripping paper from a printing couple. A flexible paper strip is held by a metal clip which is adjustably mountable onto a printing-press. In the event that the strip is improperly placed, it may be drawn out of its clip and fed through the press, thus preventing harm to the printing machine.

U.S. Pat. No. 2,211,766 to Brown, Jr. describes a stripping device for removing sheets from a drum of a printing press. The stripper comprises a plate bent to form a plurality of creased portions which provide closely spaced sheet-contacting surfaces. The stripper is adapted to lie close to a printing member and the sheet-contacting surfaces are sufficiently narrow to avoid collection or smearing of the ink.

U.S. Pat. No. 3,936,045 to Ariyama describes a sheet pick-off member comprising a thin strip conforming to the configuration of a photoconductive drum. A narrow strip of copy material extends along a side of the drum and moves over the stripping member as the length of the copy material moves under a transfer corona. A projecting portion of the thin strip then moves a leading corner of the copy material away from the drum and into the nip of a turn roll and a rubber belt which then carry the sheet away from the photoconductive drum.

These prior art stripper mechanisms can be generally characterized as providing a wedge surface with a very sharp point in contact with the roll member. They present a relatively smooth sloping surface upon which the separated copy sheet glides for some distance before separating completely.

It has been found that, for certain applications, these prior art systems are unsatisfactory to effect desired sheet removal. For example, for fusing systems used in wide document copiers such as the Xerox 2510 the fuser roll has a cylindrical form which may exceed 36 inches in length. For rollers of this length, it has proved difficult to maintain machining tolerances to completely eliminate roller eccentricity during rotation. In other words, the rollers have some degree of wobble during rotation. For the prior art wedge sharp-edged rollers, even a slight eccentricity is sufficient to cause gouging of the roll surface by the rigidly mounted fingers. According to one aspect of the invention, the stripper fingers are constructed of a thin sheet metal material. The left-off (finger) portion has a generally curved surface and is positioned so as to flexibly conform to the fuser roll surface at the pickoff angle. The fingers portion conforms to the roller surface even through a wobble excursion.

A second problem with the fuser systems of wide document copiers is that of contamination usually incurred with using acetate sheets as the record medium. The acetate sheets have a tendency to leave an oil deposition on any frictionally engaging surface. Prior art stripper fingers presenting a relatively smooth surface to the copy sheet being removed tend towards an oil deposition buildup on the finger surface. This buildup, in turn, contaminates subsequent copies. As another aspect of the present invention, the stripper fingers are provided with increasingly elevated edges which carry the copy sheets away from the finger surface. Since the copy sheets are riding on very thin edges, the oil deposition problem is minimized. It has been found that the raised edges also increase the beam strength of the fingers, enabling the fingers to separate relatively heavy stack copy paper without deforming. More particularly, the invention relates to a sheet separation mechanism for effecting removal of a record medium from a roll member, said mechanism comprising:

a plurality of flexible elongated stripping fingers positioned proximate and along the width of said roll member surface, said stripping fingers having a generally curved flexible tip portion adapted to effect initial separation of the record medium from the roll member, each finger having at least one rigid edge segment protruding upward from said finger and adapted to gradually guide the record medium away from the stripping finger surface.

DETAILED DESCRIPTION OF THE INVENTION

Figure 1:
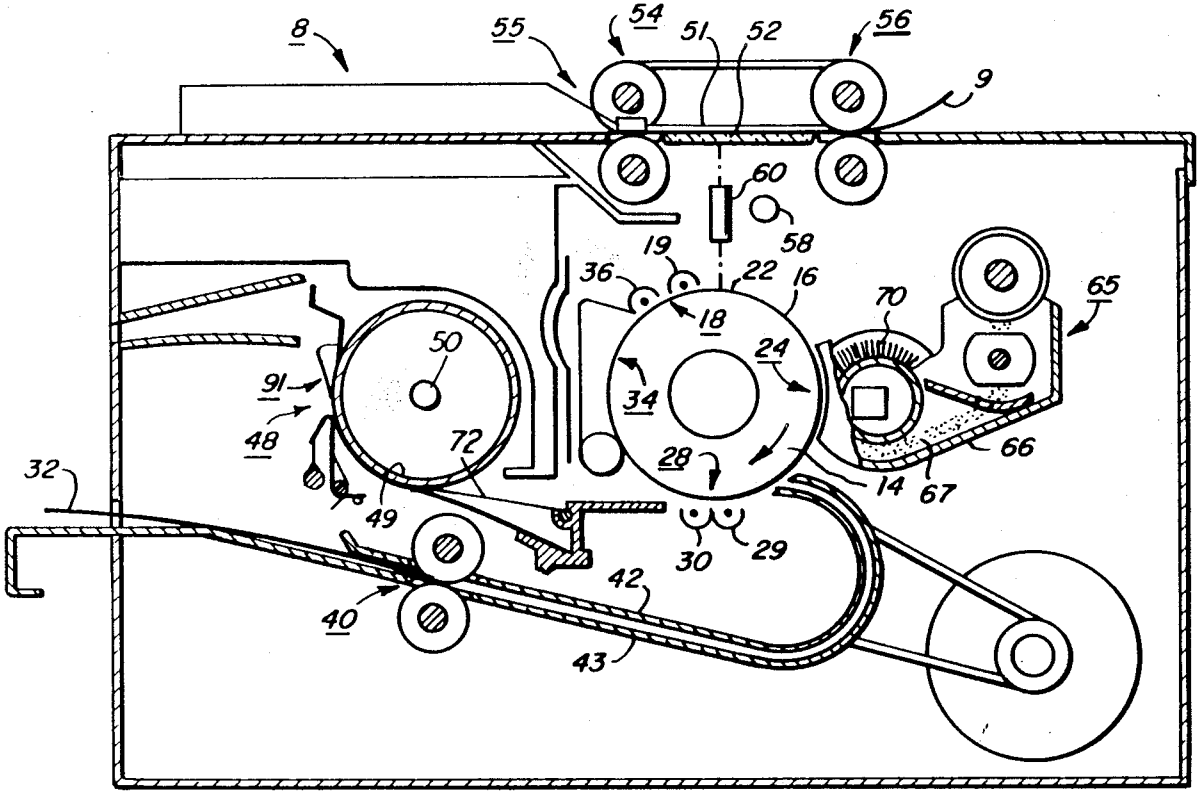
FIG. 1 is a side view in section of a reproduction machine having the stripper finger mechanism of the present invention.

Referring to FIG. 1 of the drawings, there is shown a xerographic type reproduction machine 8 incorporating the present invention. Machine 8 has a suitable frame 12 on which the machine xerographic components are operatively supported. Briefly, as will be familiar to those skilled in the xerographic printing and copying arts, the xerographic components of the machine include a charge retentive recording member, shown here in the form of a rotatable photoreceptor 14. In the exemplary arrangement shown, photoreceptor 14 comprises a drum having a photoconductive surface 16. Other photoreceptor types such as belt, web, etc. may instead be employed.

Operatively disposed about the periphery of photoreceptor 14 are a charging station 18 with charge corotron 19 for placing a uniform charge on the photoconductive surface 16 of photoreceptor 14; exposure station 22 where the previously charged photoconductive surface 16 is exposed to image rays of a document 9 being copied or reproduced to thereby form a latent electrostatic image on the charge retentive surface; development station 24 where the latent electrostatic image created on photoconductive surface 16 is developed by toner; combination transfer and detack station 28 with transfer corotron 29 and detack corotron 30 for sequentially transferring the developed image to a suitable copy substrate material such as a copy sheet 32 brought forward in timed relation with the developed image on photoconductive surface 16, and cleaning station 34 with discharge corotron 36 for removing leftover developer from photoconductive surface 16 and neutralizing residual charges thereon.

A copy sheet 32 is brought forward to transfer station 28 by feed roll pair 40. Sheet guides 42, 43 serve to guide the sheet through an approximately 180° turn prior to the copy substrate reaching the transfer station 28. Following transfer, the sheet 32 is carried forward to a fusing station 48 where the toner image is contacted by fusing roll 49 forming one member of a heat and pressure fuser. Fusing roll 49 is heated by a suitable heater such as quartz lamp 50 disposed within the interior of roll 49. After fusing, the copy sheet 32 is separated from roll 49 by stripper finger mechanism described in further detail below.

A transparent platen 51 supports the document 9 as the document is moved past a scan area 52 by a constant velocity type transport 54. As will be understood, scan area 52 is, in effect, a scan line extending across the width of platen 51 at a desired point along platen 51 where the document is scanned line-by-line as the document is moved along platen 51 by transport 54. Transport 54 has input and output document feed roll pairs 55, 56 respectively on each side of scan area 52 for moving document 9 across platen 51 at a predetermined speed. Exposure lamp 58 is provided to illuminate a strip-like area of platen 51 at scan area 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 70 is disposed in a predetermined operative relation to the photoconductive surface 16 in developer housing 65, roll 70 serving to bring developer from sump 66 into developing relation with photoreceptor 14 to develop the latent electrostatic images formed on the photoconductive surface 16.

The fuser roll 49 comprises a thin-walled metal tube having a thin (i.e. approximately 0.005 inch (0.01 centimeters)) coating of silicone rubber on the exterior surface thereof which contacts the toner images on the copy substrate to thereby affix them to the substrate. A release agent management system, not shown, applies a thin layer of silicone oil to the surface of hte fuser roll for the prevention of toner offset thereto as well as reducing the torque required to effect rotation of the fuser roll. In one operative embodiment of the fuser roll its diameter was 3.3 inches and 40 inches (1.01 meters) in width. This embodiment is typically used to fuse images on copy substrates that are 3 feet (0.91 meters) wide by 4 feet (1.22 meters) in length. The substrates typically range in thickness from 1–5 mils and may comprise paper vellum or polyester stock.

The fuser station 48 in the preferred embodiment also comprises a non-rotating, elongated pressure member 72 herein illustrated as a web or sling.

Figure 2:
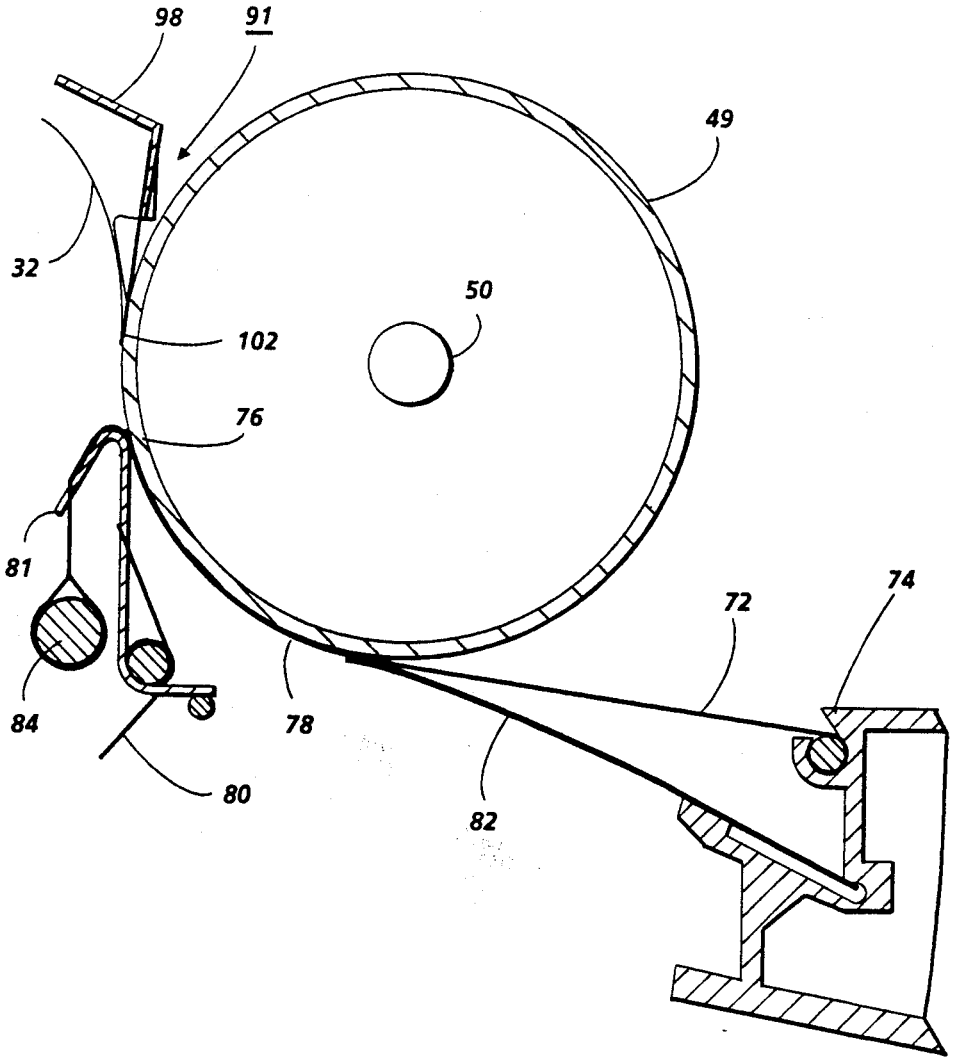
FIG. 2 is an enlarged schematic view of the preferred embodiment of the stripper finger mechanism in operative engagement with a fuser roll.

As viewed in FIG. 2, one end of the sling 72 is anchored in a frame structure 74. The opposite end of the sling is biased into engagement with the fuser roll such that the fuser roll and the sling cooperate to form an elongated nip 78 therebetween. A spring mechanism 80 which bears against a bracket 81 creates a force between the roll and the sling so as to produce a frictional force therebetween that keeps the sling in tension so it can provide suitable pressure to the surface of the fuser roll. Weight 84 is used to keep slack out of the sling during machine idle time while adding to the tensioning force during operation.

A blade member 82 has one end anchored in the frame structure 74 while its other end contacts the sling as indicated to apply a load against the sling and thereby cooperate with the spring mechanism 80 to effect the required pressure in the nip for satisfactory operation.

Figure 3:
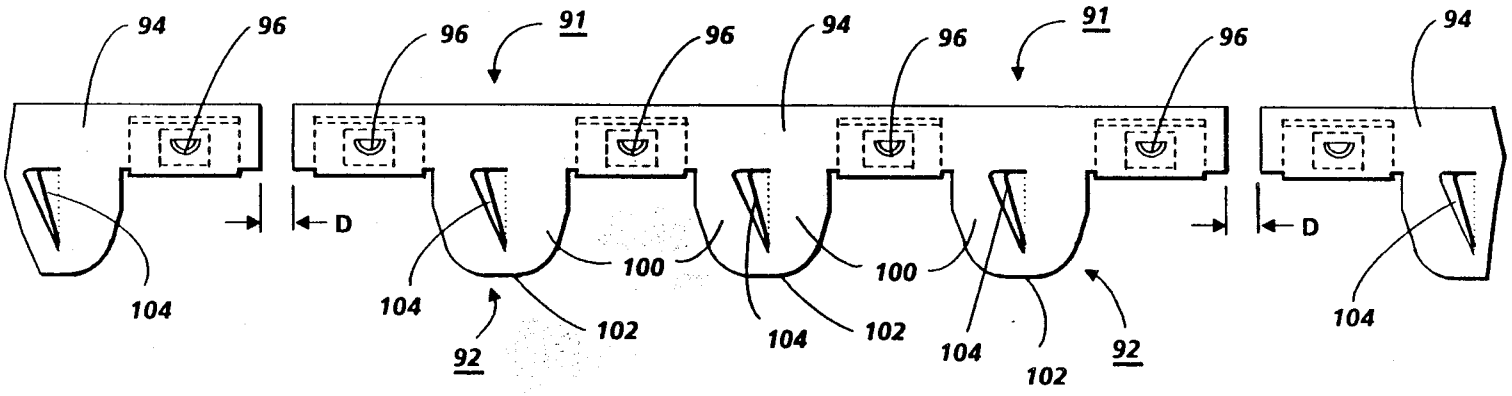
FIG. 3 is a top view of the stripper finger mechanism of FIG. 2.
Figure 4:
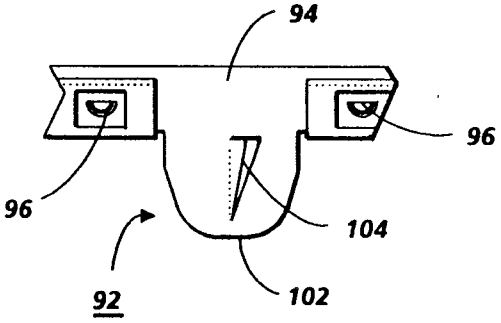
FIG. 4 is a back view of the stripper finger of FIG. 3.
Figure 5:
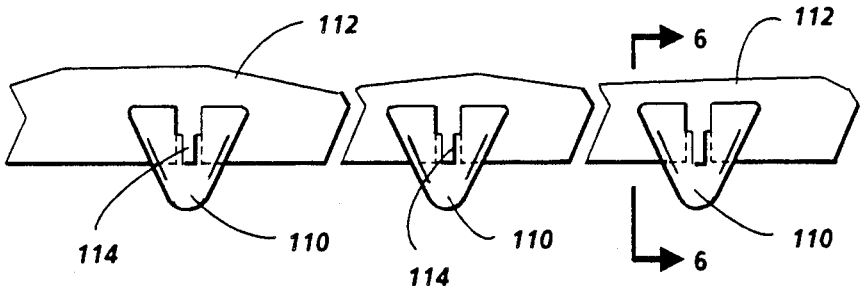
FIG. 5 is a top view of a second embodiment of a stripper finger mechanism according to the present invention.
Figure 6:
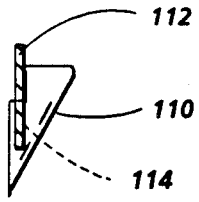
FIG. 6 is a side view of the stripper finger of FIG. 5.
Figure 7:
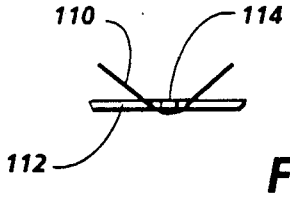
FIG. 7 is a frontal view of the stripper finger of FIG. 5.

Turning now to a preferred embodiment of the stripper mechanism; shown in side view in FIG. 2 and in top view in FIG. 3, the mechanism comprises a plurality of three-finger thin sheet metal strips 91 located along the width of the fuser roll. The strips are separated from each other by a distance "D" which can be varied, depending on system requirements. Each finger 92 extends from a generally rectangular base portion 94. Base 94 has a plurality of mounting tabs 96 which enable snap-in mounting to mating holes on mounting bracket 98. Bracket 98 extends along the entire width of the fuser roll. Finger 92 consists of a tab section 100 with a generally curved flexible end portion 102. Centrally located in section 100 is a raised, generally triangular edge 104 which is formed by cutting two sides of the triangle and folding the cut-out section outward, as viewed from FIG. 4. Edge 104 therefore extends roughly perpendicular to the surface of section 100 and forms the hypotenuse of the triangle. For operation, and referring to FIGS. 2 and 3, the fused copy sheet 32 emerges from the nip area 78. Assuming that the paper adheres to the fuser roll surface, it will proceed to the point where the flexible end portions 102 of fingers 92 engage and detach the end of the sheets from the roller. As the sheet continues its upward travel, it is gradually lifted from the finger surface 100 by riding along the edges 104. It will be appreciated that the orientation of edges 104 greatly increase the beam strength of the stripper fingers. It will also be appreciated that, for example, if fused copy sheet 32 were made of polyester, any oil deposition will occur only along the thin edge portion, thereby minimizing contamination of subsequent copies. Although the preferred embodiment used a plurality of three-finger sections located along the fuser roll width, the sections many contain fewer or more fingers, the total number being a function of fuser roll width and amount of force required to separate the sheet from the roll Other stripper finger embodiments can be utilized consistent with the concept of providing a stripper finger with edge portions. FIG. 5 shows a top view of a plurality of stripper finger 110 which have been mounted on a backer plate 112 by flexing the finger sides upwards and inserting it into slots 114 on the backer plate. FIG. 6 is a side view and FIG. 7 is a frontal view of a single finger. The upwardly flexed edges of the finger increase the beam strength of the finger and also prevent copy oil contamination in the same manner as the stripper finger embodiment of FIGS. 2, 3, and 4. The design would be relatively inexpensive to manufacture since there is no forming required; the finger remains in the flat state until it is assembled to the backer plate.

Figure 9:
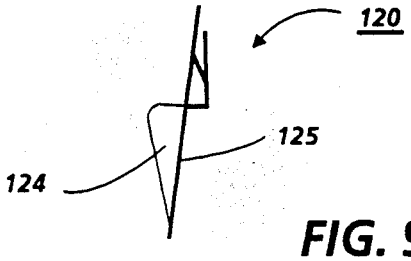
FIG. 9 is a side view of the stripper finger of FIG. 8.
Figure 8:
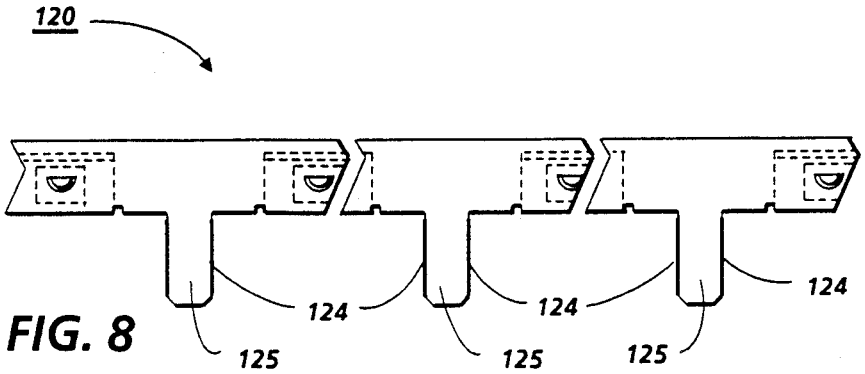
FIG. 8 is a top view of another embodiment of a stripper finger mechanism.

FIG. 8 shows a top view of a stripper finger 120 which is a variation of finger 92. Finger mechanism 120 is formed from a single thin sheet of metal and has a plurality of "winged" fingers 124 extending from a rectangular base 125. The side edges of finger 124 are triangular in shape and have been bent upwards at right angles. FIG. 9 shows a side view of finger 120.

The finger embodiments described above can be made of a thin sheet (2 to 5 mils thick) metal formed in a die stamping process. Fingers made of sheets approximately this thickness have been found suitable for fuser roll stripping applications. Changes in finger thickness and/or structure may be made, consistent with the principles of the present invention. For example, the fingers may be adapted to assist in detacking copy paper from a transfer location. For this application, the fingers may be constructed of a thin plastic material approximately 3 to 5 mils thick.

While the invention has been described with reference to the structure disclosed, it is not confined to the details set forth, but is intended to cover such modifications or changes as may come within the scope of the following claims:

What is claimed is:

1. A sheet separating mechanism for effecting removal of a record medium from a roll member, said mechanism comprising:

a plurality of flexible elongated stripping fingers positioned proximate and along the width of said roll member surface, said stripping fingers having a generally curved, flexible, tip portion adapted to effect initial separation of the record medium from the roll member surface, each finger having at least one rigid edge segment protruding upward from said finger and extending in the direction of record medium travel, said edge segment (and) adapted to gradually guide the record medium away from the stripping finger surface.

2. The sheet separating mechanism of claim 1 wherein said rigid edge segments have a generally triangular configuration, the hypotenuse of the segment forming the edge which supports the record medium.

3. The sheet separating mechanism of claim 1 wherein said stripper fingers are integrally formed on a plurality of rectangular strip bases, each base having a plurality of fingers associated therewith, each strip base having a plurality of mounting notches formed along its length, said notches positioned so as to mate with a mating surface in fixed location above the roller member strip-off point.

4. A sheet stripping mechanism for effecting removal of copy sheets from a roll member, said mechanism comprising:

a plurality of thin flexible elongated finger members having the stripping end forming a generally curved tip, said finger member adapted to be flexed into a semi-circular configuration;

a support member for supporting said finger members and for mounting said finger members in said flexed position said finger members, when mounted, having side edges extending away from said support member; and means for biasing said support member so that the wedge shaped tip of said stripper member contacts said roll member, conforming said tip to the curve of said roll member, thereby effecting separation of the edge of the copy sheet from the roll member, said copy sheet being transported along said side edges.

* * * * *